United States Patent [19]

Irwin

[11] Patent Number: 4,899,547

[45] Date of Patent: Feb. 13, 1990

[54] HOT STRIP MILL COOLING SYSTEM

[75] Inventor: Richard D. Irwin, Mount Clemens, Mich.

[73] Assignee: Even Flow Products, Inc., Centerline, Mich.

[21] Appl. No.: 292,562

[22] Filed: Dec. 30, 1988

[51] Int. Cl.[4] ..... F25D 13/06

[52] U.S. Cl. ..... 62/63; 62/216; 62/223; 62/374; 72/13

[58] Field of Search ..... 72/13; 62/63, 374, 380, 62/223, 216

[56] References Cited

U.S. PATENT DOCUMENTS

| | | | |
|---|---|---|---|
| 3,613,418 | 10/1971 | Nara et al. | 72/8 |
| 3,771,730 | 11/1973 | Niedoff et al. | 239/536 |
| 3,779,054 | 12/1973 | Greenberger | 72/13 |
| 3,905,216 | 9/1975 | Hinrichsen | 72/13 |
| 4,274,273 | 6/1981 | Fapiano et al. | 73/13 |
| 4,356,760 | 11/1982 | Bouteille | 91/445 |
| 4,379,396 | 4/1983 | Hope et al. | 72/13 |
| 4,387,739 | 6/1983 | Schaming | 137/884 |
| 4,408,903 | 10/1983 | Baldasarri | 374/121 |
| 4,559,819 | 12/1985 | Deppe et al. | 72/13 |
| 4,610,144 | 9/1986 | Lawson | 62/63 |
| 4,675,826 | 6/1987 | Gentry et al. | 72/13 |
| 4,738,400 | 4/1988 | Irwin | 239/536 |
| 4,768,363 | 9/1988 | Yamashita et al. | 72/13 |

OTHER PUBLICATIONS

Thermoprofile 5, Publication No. 556556749 Ed II, Agema Infrared Systems AB 1987.

A reprint from the Proceedings of SPIE–The International Society for Optical Eng., 4–6 Jun. 1986, vol. 665.

Hot Strip Mill Profile and Flatness Study, Phase 1, Association of Iron and Steel Engineers, Oct. 1986.

Improvement of Production Technology on 2500 Strip Mill, S. A. Bratus, L. V. Radyukevich et al, vol. 13, May 1983.

Control & Instrumentation in the Steelworks, Steel Times, Oct. 1979, pp. 746–747.

A Systematic Study of the Factors Controlling Ingot-to-Strip Yield, Energy and Quality, J. R. Cook et al., I*SM, Mar. 1984, pp. 22–29.

Noncontact Pyrometry in Hot Srip Mills and Reheat Furnaces, G. Raymond Peacock, Iron & Steel Engineer, May 1982, pp. 30–38.

Temperature Distribution Measurement with a Silicon Photodiode Array, Yamada et al, 1982, American Institute of Physcis.

MPP/MPZ Electro-Pneumatic Proportional Pressure Regulator Valve, Festo Pneumatic Brochure, 1988.

*Primary Examiner*—Ronald C. Capossela

*Attorney, Agent, or Firm*—Brooks & Kushman

[57] ABSTRACT

An apparatus and method for cooling a strip of moving metal in a hot strip mill, or the like, is disclosed. The apparatus utilizes an infrared sensor for measuring a temperature profile across a transverse section of the strip. A coolant manifold is utilized to apply coolant to the metal strip after the temperature is measured from a plurality of independently controllable outlets in the manifold transversely spaced across the strip. A controller adjusts the flow of coolant of the outlets in response to the transverse temperature measurements to selectively cool the strip in order to establish an uniform temperature profile.

25 Claims, 2 Drawing Sheets

HOT STRIP MILL COOLING SYSTEM

FIELD OF INVENTION

This invention relates to the field of cooling systems for a moving strip, and more particularly to a hot strip rolling mill cooling apparatus and method.

BACKGROUND OF INVENTION

Sheet metal is commonly formed utilizing a combination of hot rolling and cold rolling to reduce an initial slab of metal into a coil of sheet having a desired thickness and metallurgical properties. Traditionally, the hot strip rolling and cold rolling operations are done separately. The initial sheet metal forming process begins with a large slab of metal. The slab may be inches thick and weigh several tons. The metal slab is initially heated in an oven to a forming temperature, which is approximately 2000° F. for steel. Once the forming temperature is achieved, the metal slab is horizontally transferred through a series of rollers which sequentially reduce the slab thickness. Frequently, the metal thickness is reduced to approximately $\frac{3}{8}''$–$\frac{3}{4}''$ during hot rolling, with the final thickness to be achieved subsequently in a cold rolling operation.

As the metal sheet slab progresses through the series of rollers, the slab initially goes through a roughing mill, and finally through a finishing mill. During the rolling process, the temperature of the sheet typically drops to approximately 1400° to 1750° F. at the mill exit. After the sheet exits the last rolling station, the sheet is cooled using coolant sprays until the temperature is dropped sufficiently to allow the strip to be coiled, i.e., approximately 850° to 1200° F. depending upon material and gage. Water sprays are typically used as a cooling medium In the past, coolant flow has been adjusted based upon an average strip temperature measurement, as shown in U.S. Pat. Nos. 3,613,418, 3,905,216, and 4,274,273, which are incorporated by reference herein. As the metal strip cools, metallurgical characteristics of the sheet are determined. There has been a great emphasis on achieving improved sheet metal quality by controlling the cold rolling operation, while the hot strip rolling process has gone relatively ignored.

OBJECTS, FEATURES AND ADVANTAGES OF INVENTION

It is an object of the present invention to minimize differences in the metallurgical characteristics of the metal sheet as it leaves the hot strip rolling mill.

It is another object of the present invention to automatically adjust coolant flow in order to maintain uniform temperature of the strip during the cooling process.

Yet another object of the present invention is to achieve uniform temperature distribution prior to the metal strip reaching the upper critical temperature.

An advantage of the present invention is the ability to automatically selectively cool the metal strip to eliminate hot and cold spots, achieving a uniform temperature profile.

An advantage of the present invention is that more uniform metallurgical characteristics of the final metal sheet can be achieved, thereby improving the quality of the form and finish of the ultimate product manufactured from a sheet.

SUMMARY OF INVENTION

A novel hot strip rolling mill cooling apparatus and method have been developed for automatically cooling a longitudinally moving strip. An infrared sensor is used for measuring the temperature of a segment of the strip at a plurality of transversely spaced apart locations A coolant manifold is oriented after the temperature sensing location for applying coolant upon a strip from a plurality of independently controllable outlets transversely spaced there across A control means adjusts the coolant flow of each of the outlets in response to the temperature measurement of the infrared sensor to selectively cool a strip to establish a desired transverse temperature profile.

In one embodiment of the invention, after the temperature profile is sensed, coolant is automatically applied by a first coolant manifold which selectively cools the strip to establish a substantially uniform temperature profile above the critical temperature of the strip. A second cooling manifold is provided, and additional coolant is applied to uniformly cool the strip to the desired coiling temperature, thereby achieving uniform physical properties of the coiled strip.

These objects and novel characteristics of the invention will become further apparent from a review of the accompanying drawings and detailed description of the preferred embodiment.

BRIEF DESCRIPTION OF PREFERRED EMBODIMENT

Figure 1:
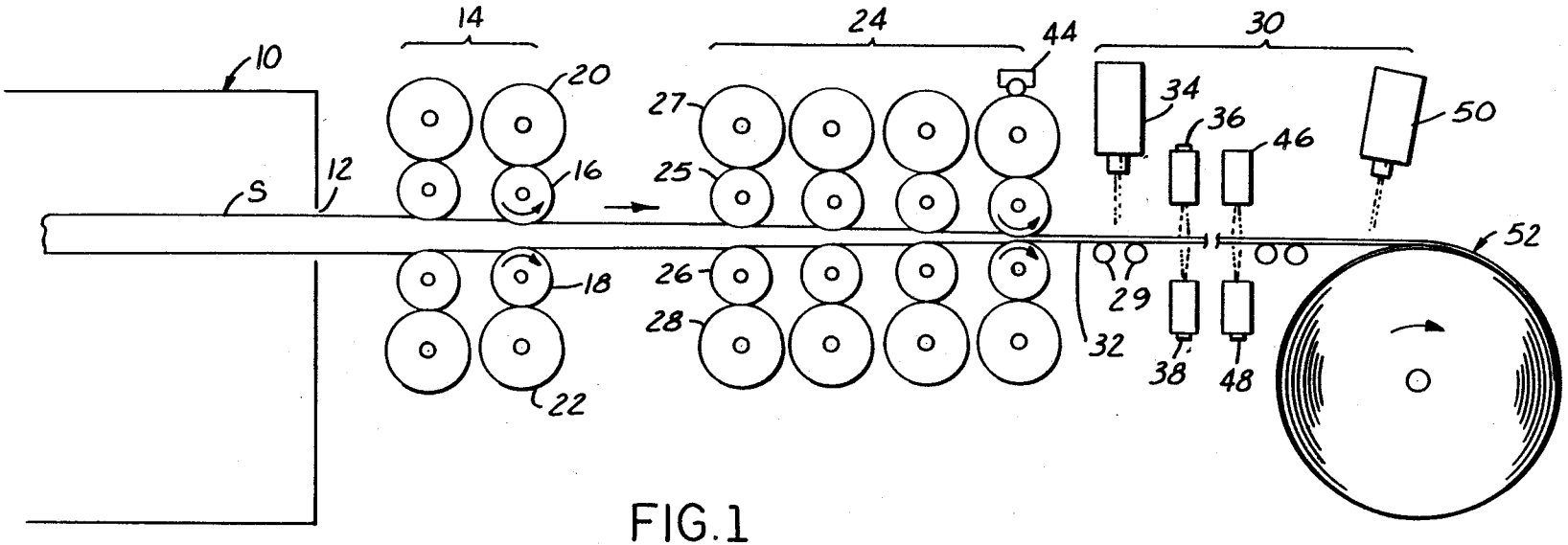
FIG. 1 is a side elevational view of a hot strip rolling mill from the furnace to coiler.

Referring to the drawings, FIG. 1 shows a side elevational view of a hot strip mill rolling apparatus shown schematically from the furnace to the coiler. It should be appreciated that the overall length of a hot strip mill may be over 100 yards long, and the device is only shown schematically for the purpose of describing the invention. A furnace 10 is provided to heat a metal slab S to the desired forming temperature. When the metal to be rolled is steel; the forming temperature will be approximately 2000° F. Once slab S has achieved the forming temperature, it is transferred horizontally out of the furnace through an exit slit 12 and is fed into the first of a series of rollers at rougher roller stations 14. The roller stations, are made up of a series of upper and lower work rolls 16 and 18, respectively, which are in direct contact with the metal sheet, and relatively larger back-up rolls 20 and 22 which support the work rolls and minimize bending. The rolls are provided with a suitable drive not shown. After the metal strip goes through a series of one or more roughing stations 14, the final metal thickness is achieved by a finishing station 24. Finishing station 24 similarly has a plurality of upper and lower work rolls 25 and 26 and upper and lower back-up rolls 27 and 28 constructed similar to the roughing station 14. Finish station rolls are similarly provided with a drive not shown, and conventional adjustment mechanisms to set the roll spacing at load.

When the metal sheet exits the last of the rollers, it is then necessary to cool the sheet so it can be coiled. During the cooling process, the metal strip is supported on a series of rollers 29, which collectively form a runout table 30. A runout table may typically be between 300 to 500 feet long in a production steel rolling mill. While the metal strip 32 moves across the runout table, it is cooled by spraying water or other cooling mediums on the upper and lower surfaces of the strip.

The present invention senses the temperature of a segment of the moving strip at the start of the runout table. In the preferred embodiment shown, infrared sensor 34 makes a plurality of temperature readings at transversely spaced apart locations across the width of metal strip 32. Infrared sensor 34 is preferably of the line scanning type which sequentially scans the transverse width of the sheet. Other types of sensors may be suitable provided they have adequate response time and measure a sufficient number of points along the transverse axis of the moving strip to give good resolution. A suitable infrared line scan sensor is available from AGEMA Infrared Systems of Secaucus, New Jersey, sold under the trademark "Thermoprofiles®5". The temperature measurements from the infrared sensor are transmitted to a microprocessor, or a computer of conventional design. The computer controls the flow of coolant which is selectively applied to the strip to achieve a desired temperature profile. Upper and lower coolant manifolds 36 and 38 apply coolant to a segment of the strip located after the infrared temperature sensor 34. The coolant manifolds are provided with a plurality of independently controllable outlets spaced transversely across metal strip 32.

Figure 2:
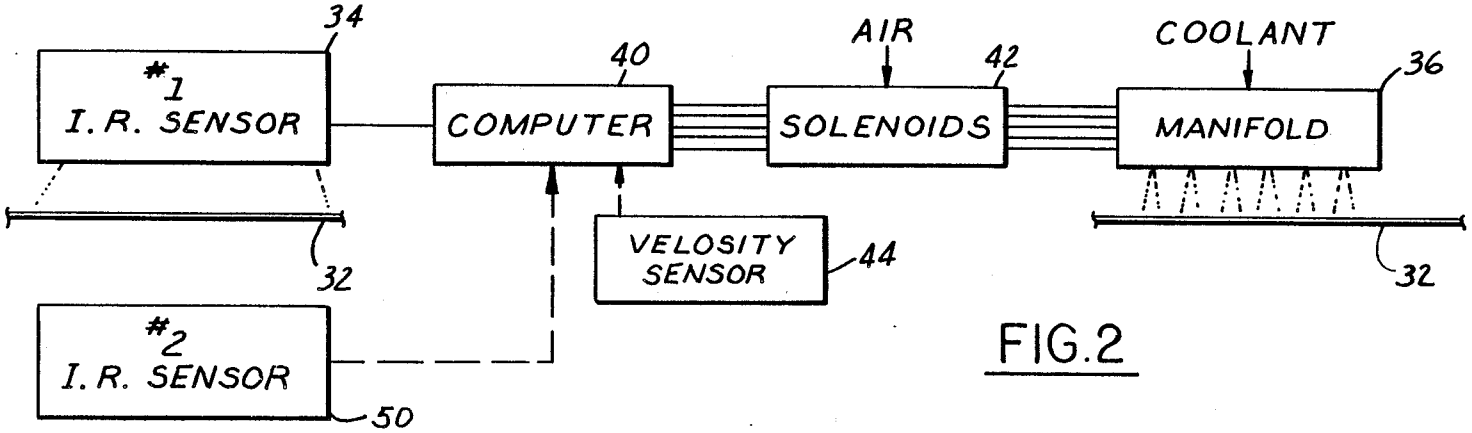
FIG. 2 is a block diagram of the cooling system.

A schematic diagram of the cooling system is shown in FIG. 2. Infrared sensor 34 scans the upper surface of metal sheet 32 and generates a series of temperature readings transversely across the sheet. This temperature data is transmitted to computer 40 which serves to control the flow of coolant from the various outlets in manifolds 36 and 38 by way of a series of electro-pneumatic solenoid valves shown collectively at 42. Since the metal strip temperature fluctuates as a function of longitudinal position on the strip, the application of coolant from manifolds 36 and 38 must be properly timed to correspond to the measured temperatures. In order to do so, the longitudinal distance between the infrared sensor and the manifold, the system response time, and the speed of the strip must be known. The speed of the strip may be input into the computer manually, or, in the preferred embodiment shown, a velocity sensor 44 is utilized to measure the relative speed of the metal sheet. The velocity sensor 44 cooperates with the last back-up roller since it has a speed proportional to the metal sheet and it is relatively cool and accessible.

Figure 3:
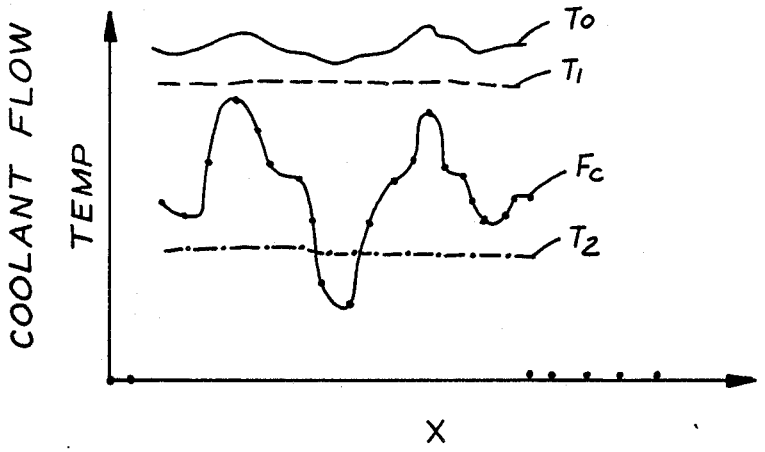
FIG. 3 shows plots of the metal strip transverse temperature profile at various longitudinal positions and includes a plot of coolant flow versus transverse position.

FIG. 3 shows a hypothetical plot of the temperature profiles of the strip at various positions on the runout table, T0, T1, T2, as well as coolant flow, plotted as a function of transverse position along the metal strip X. Initial temperature of the metal strip is depicted by curve T0. T0 is the temperature profile initially measured by infrared temperature sensor 34. In order to achieve a flat temperature profile, it is necessary to selectively cool the metal strip more in some locations than others. Curve Fc depicts the required coolant flow rate as a function of transverse position. The central nozzles where the metal strip is the coolest, will flow very little coolant, while other nozzles corresponding to hot regions of the metal strip will have high flow. After the metal strip passes the coolant manifolds, 36 and 38, which are controlled by the computer in response to the sensed temperature, the metal strip should have achieved a relatively uniform temperature profile, as shown by curve Tl in order for the ultimate metal sheet to have uniform metallurgical characteristics. For steel, the metallurgical characteristics are for all practical purposes established as the metal cools through the approximate 1400° to 800° F. range. The rate of cooling through this range dictates the metallurgical properties. The upper limit of this range is defined, as the upper critical temperature, and the lower of this range is defined as the lower critical temperature. The critical temperature range limits will vary between different materials, but the metallurgical principal remains unchanged. In order to achieve optimum uniformity of metallurgical characteristics, an uniform temperature will be established before the metal sheet reaches the upper critical temperature. Further, cooling of the metal strip can then be done utilizing an uniform cooling spray to achieve the desired uniform cooling rate and the uniform metallurgical characteristics of the resulting sheets. Preferably, the metal sheet is uniformly cooled to below lower critical temperature prior to coiling.

As shown in FIG. 3, temperature T2 represents the temperature of the steel sheet after passing the last of the second series of coolant manifolds 46 and 48. FIG. 1 shows a single pair of first cooling manifolds, 36 and 38, which are controlled by the computer to selectively cool the metal strip, and a single pair of second manifolds, 46 and 48, which uniformly cool the metal strip. It should be appreciated that in order to achieve the necessary cooling in a high speed production operation, several pairs of first manifolds and several pairs of second manifolds may be necessary. Since the metal sheet is at a substantially uniform temperature after being cooled by the first manifold, the second manifold need not necessarily be automatically controlled. In order to monitor the performance of the system, and to quickly locate cooling problems, a second infrared sensor 50 can be placed at the end of the runout table immediately prior to the coiling station 52.

It should be appreciated that in some instances, due to process constraints or high temperature variation of the metal strip, it may not be possible to totally achieve a substantially uniform temperature profile prior to the metal sheet reaching the upper critical temperature. The apparatus and process, however, is still quite beneficial in minimizing the metallurgical differences across the metal sheet.

Figure 4:
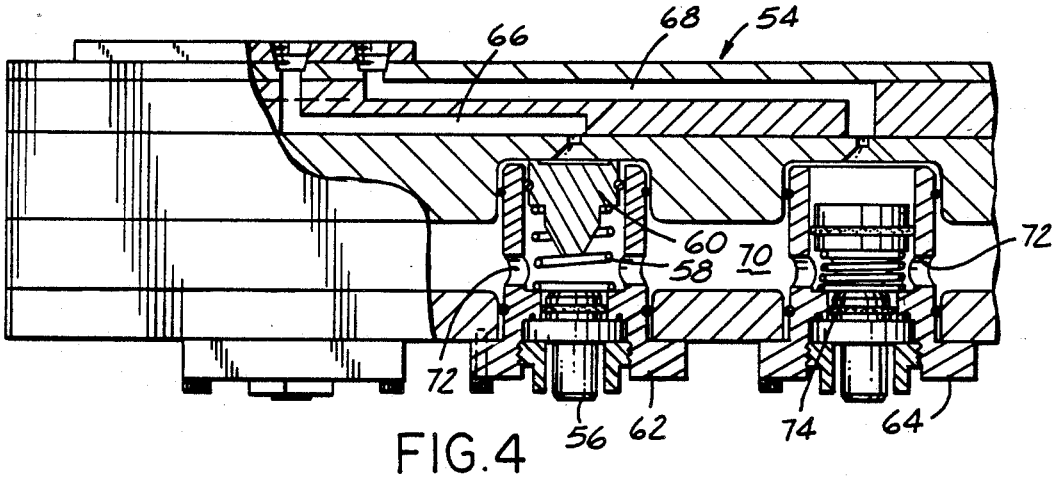
FIG. 4 is an enlarged, partial cut-away sectional side view of a coolant manifold.

In order to proportionally control the flow of coolant as a function of transverse position across the strip, a coolant manifold 54 having independently controllable outlets 56 is used as shown in side cross-sectional elevation in FIG. 4. Cooling manifold 54 is substantially similar to the spray bar assembly shown and described in U.S. Pat. No. 4,738,400, which is incorporated by reference herein. The primary difference between the spray bar assembly of U.S. Pat. No. 4,738,400 and the cooling manifold utilized in the present invention is the addition of spring 58 which maintains spool valve 60 in the normally open position. The spool valve is shiftable between an open position, as shown in valve assembly 62, and a closed position, shown in valve assembly 64, or any position intermediate therebetween, by a pneumatic pressure signal applied to pressure ports 66 and 68. When a valve is in the open position, pressurized coolant within manifold cavity 70 enters inlet port 72 and is discharged through outlet 56. The coolant flow rate for each valve is determined by the relative position of the spool valve and the coolant pressure. When the valve is in the raised position, as shown in valve 62, flow is at the maximum level, and when the valve is in the closed position, as shown in valve 64, spool valve 60 sealingly cooperates with circular seat 74, and all flow is obstructed. Flow rate of coolant through each valve is independently controlled by varying the pressure in the corresponding pressure port.

The valve assemblies are located preferably on 2" centers, and extend across the entire length of the manifold which transversely spans the metal strip. Nozzles located on 2" centers provide sufficient control to adequately selectively cool the metal strip to minimize temperature irregularities. For additional coolant flow and to improve flow control, a second row of valve assemblies located on a 2" center can be spaced longitudinally behind, and transversely shifted, relative to the first row so that an independently controlled valve is located every inch.

In order to control each of the valve assemblies using the computer, a solenoid is provided for each of the independently controlled valves. An electro-pneumatic solenoid which proportionally regulates pneumatic pressure as a function of an analog voltage input function allows the computer to interface with the pilot operated cooling valves. An electro-pneumatic proportional pressure regulator built by Festo Corporation of Hauppauge, New York, identified by using the MPP/MPZ trademark, works quite satisfactorily and will interface directly with a conventional programmable controller. It should be understood from the schematic diagram of FIG. 2, that computer 40 provides electrical signals to a series of solenoids which are each coupled to a source of pressurized air. The solenoids send a pneumatic signal to the corresponding valve located in the manifold which varies as a function of the desired cooling flow rate. Pressurized coolant is supplied to the manifold and to each of the individual valves for application to the strip. While FIG. 2 shows a single coolant manifold, it should be appreciated that in most applications, a corresponding lower flow coolant manifold will be oriented and aligned in a position on the opposite side of the metal strip, so that uniform cooling is achieved.

Figure 5:
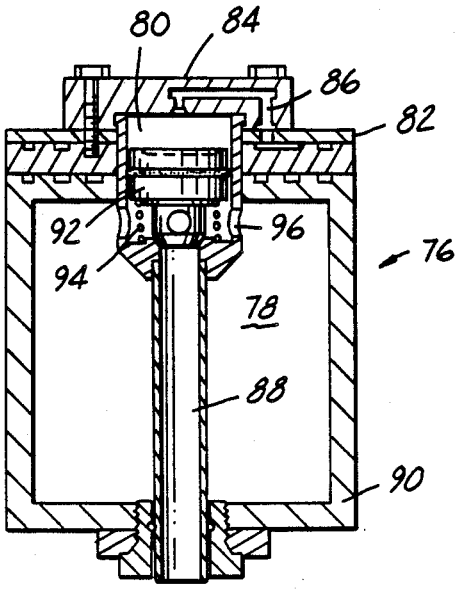
FIG. 5 is an enlarged, cut-away end view of an alterative embodiment of a coolant manifold.

An alternative embodiment of the manifold is shown in FIG. 5, which is a cross-sectional end view of the manifold 76. Manifold 76 is adapted for high coolant flow applications, and internal cavity 78 is appropriately increased in size to handle the higher flow rates. The manifold is constructed somewhat similarly to the manifold 54, however, valve assembly 80 is installed through top plate 82, and held in place by a retainer plate 84, which has an internal passageway 86 to communicate with the pilot pressure signal to the valve assembly. Valve assembly 80 is provided with an outlet tube 88, which projects sealingly through bottom plate 90. Valve assembly 80 is further provided with an internal valve spool 92, spring 94, and inlet ports 96 which operate in a manner similar to the first embodiment.

The method of cooling the moving metal strip utilized by the described apparatus is likewise novel. The method of cooling a segment of longitudinally moving strip comprises the steps of sensing temperatures, providing a coolant manifold, and automatically regulating the coolant flow in response to the sensed temperature to apply coolant to selectively cool the strip. Preferably, the method also comprises providing a second cooling manifold and supplying additional coolant to the strip to further cool the strip uniformly. When the moving strip of steel is rolled using the preferred method, the first coolant manifold selectively cools the strip in order to achieve a substantially uniform temperature profile prior to the strip reaching the upper critical temperature limit. Further, cooling the strip using subsequent coolant manifolds uniformly reduces the temperature to below the lower critical temperature limit.

An initial transverse temperature profile is determined by sensing the temperature across a segment of the moving strip at a plurality of locations transversely spaced across the strip. A cooling manifold is provided to apply coolant to a segment of the strip after the temperature has been sensed from a plurality of independently controlled outlets spaced transversely thereacross. This step of automatically regulating the coolant flow is achieved by independently varying the flow of the manifold outlets in response to the sensed temperature to selectively cool the strip in order to establish the desired transverse temperature profile.

Preferably, the step of sensing a temperature is achieved by sensing the infrared radiation of the strip by scanning the strip to establish a plurality of transverse temperature profiles. The preferred embodiment utilizes a velocity sensor to automatically regulate the coolant flow in response to the sensed temperature.

It should be understood, of course, that while the invention herein shown and described constitutes a preferred embodiment of the invention, it is not intended to illustrate all possible forms thereof. Cooling systems can be designed having various alternative structures and methods of operation by one of ordinary skill in the art without departing from the spirit and scope of the invention disclosed and claimed.

I claim:

1. An apparatus for applying coolant to a segment of a longitudinally moving strip, said apparatus comprising:

an infrared sensor for measuring the temperature of a segment of the strip at a plurality of locations spaced transversely across the strip;

a coolant manifold for applying coolant to the segment of strip after the temperature is sensed from a plurality of independently controllable outlets spaced transversely across the strip; and control means for adjusting the coolant flow rate of each of the outlets in response to the temperature measurement, selectively cooling the strip in order to establish a desired transverse temperature profile.

2. The invention of claim 1 further comprising velocity means for providing a velocity signal proportional to strip velocity, wherein said control means further adjusts the coolant flow rate in response to the velocity signal.

3. The invention of claim 2 wherein the velocity means further comprises a velocity sensor which automatically varies the velocity signal with changes in strip speed.

4. The invention of claim 1 wherein the strip moves in a substantially horizontal direction and the coolant manifold further comprises upper and lower manifolds aligned on opposite sides of the strip.

5. The invention of claim 1 wherein said control means further comprises a computer controller and a plurality of variable flow coolant valves which regulate the flow of the manifold outlets.

6. The invention of claim 5 wherein said variable flow valve further comprises a plurality of electro-pneumatic proportional regulators cooperating with the computer controller and supplying a pneumatic signal to a pilot operated coolant flow valve oriented within the coolant manifold and cooperating with corresponding outlet.

7. An apparatus for applying a coolant to a segment of a longitudinally moving metal strip in a hot strip rolling mill, said apparatus comprising:

an infrared sensor for measuring the temperature of a plurality of transversely spaced apart points on a segment of the metal strip to establish an internal temperature profile across the width of the strip;

a first coolant manifold for applying cooling to a segment of metal strip after the temperature is sensed from a plurality of independently controllable outlets spaced transversely across the strip;

control means for adjusting the coolant flow rate of each of the first manifold outlets in response to the temperature sensed, to selectively cool the metal strip in order to establish a desired uniform temperature across the strip, above the critical temperature; and a second coolant manifold longitudinally spaced after the first manifold for applying additional coolant to the strip to uniformly cool the strip to a selected coiling temperature.

8. The invention of claim 7 further comprising velocity means for providing a velocity signal proportional to strip velocity, wherein said control means further adjusts the coolant flow rate in response to the velocity signal.

9. The invention of claim 8 wherein the velocity means further comprises a velocity sensor which automatically varies the velocity signal with changes in strip speed.

10. The invention of claim 7 wherein the strip moves in a substantially horizontal direction and the coolant manifold further comprises upper and lower manifolds aligned on opposite sides of the strip.

11. The invention of claim 7 wherein said control means further comprises a computer controller and a plurality of variable flow coolant valves which regulate the flow of the manifold outlets.

12. The invention of claim 11 wherein said variable flow valve further comprises a plurality of electro-pneumatic proportional regulators cooperating with the computer controller and supplying a pneumatic signal to a pilot operated coolant flow valve oriented within the coolant manifold and cooperating with corresponding outlet.

13. A method of cooling a segment of longitudinally moving strip, comprising:

sensing the temperature of a segment of moving strip at a plurality of locations transversely spaced thereacross;

providing a coolant manifold for applying coolant to the segment strip after the temperature is sensed from a plurality of independently controllable outlets space transversely across the strip; and automatically regulating the coolant flow rate of each of the outlets in response to the sensed temperature to selectively cool the strip in order to establish a desired transverse temperature profile.

14. The method of claim 13 wherein the sensing step further comprises sensing the infrared radiation of the strip.

15. The method of claim 14 wherein the sensing infrared radiation step further comprises sequentially transversely scanning the strip to establish a plurality of transverse temperature profiles.

16. The invention of claim 13 wherein the step of providing a coolant manifold further comprises providing upper and lower manifolds aligned on opposite sides of the strip.

17. The method of claim 13 further comprising the sensing the strip velocity and wherein the step of automatically regulating the coolant flow further comprises regulating the coolant flow in response to the sensed velocity.

18. The method of claim 13 wherein the step of automatically regulating the coolant flow further comprises adjusting the flow of the coolant to cool the strip to a substantially uniform temperature while maximizing the average strip temperature.

19. The method of claim 18 further comprising the step of further cooling the strip while maintaining a substantially uniform temperature profile there across.

20. A method of cooling a segment of metal strip in a hot strip rolling mill, comprising:

sensing the temperature of a segment of the metal strip at a plurality of locations spaced transversely thereacross;

providing a first coolant manifold for applying coolant to the segment of metal strip after the temperature is sensed from a plurality of independently controllable outlets transversely spaced thereacross;

automatically regulating the coolant flow rate of the first manifold outlets in response to the sensed temperatures to selectively cool the strip to establish a substantially uniform temperature profile above the upper critical temperature of the metal;

providing a second coolant manifold longitudinally spaced after the first coolant manifold; and supplying additional coolant to the metal strip using the second coolant manifold to uniformly cool the strip to a selected coiling temperature.

21. The method of claim 20 wherein the sensing step further comprises sensing the infrared radiation of the strip.

22. The method of claim 21 wherein the sensing infrared radiation step further comprises sequentially transversely scanning the strip to establish a transverse temperature profile.

23. The invention of claim 20 wherein the step of providing a coolant manifold further comprises providing upper and lower manifolds aligned on opposite sides of the strip.

24. The method of claim 20 further comprising the sensing the strip velocity and wherein the step of automatically regulating the coolant flow further comprises regulating the coolant flow in response to the sensed velocity.

25. The method of claim 20 wherein the coiling temperature is below the lower critical temperature of the metal.

* * * * *